US007506384B2

(12) United States Patent
Ide et al.

(10) Patent No.: US 7,506,384 B2
(45) Date of Patent: Mar. 24, 2009

(54) SHOULDER PAD FOR CONTACT SPORTS

(75) Inventors: Thad M. Ide, Chicago, IL (US); Christopher D. Oby, Barrington, NH (US)

(73) Assignee: Riddell, Inc., Rosemont, IL (US)

( * ) Notice: Subject to any disclaimer, the term of this patent is extended or adjusted under 35 U.S.C. 154(b) by 101 days.

(21) Appl. No.: 11/224,493

(22) Filed: Sep. 12, 2005

(65) Prior Publication Data

US 2006/0053535 A1 Mar. 16, 2006

Related U.S. Application Data

(60) Provisional application No. 60/609,489, filed on Sep. 13, 2004.

(51) Int. Cl.
*A41D 13/00* (2006.01)

(52) U.S. Cl. ..... 2/459

(58) Field of Classification Search ..... 2/455, 2/44, 45, 267, 268, 94, 102, 459
See application file for complete search history.

(56) References Cited

U.S. PATENT DOCUMENTS 4,295,227 A * 10/1981 Mitchell ..... 2/462
4,322,859 A * 4/1982 Mitchell ..... 2/462
4,441,211 A 4/1984 Donzis
4,467,475 A * 8/1984 Gregory et al. ..... 2/462
4,486,901 A 12/1984 Donzis
4,513,449 A 4/1985 Donzis
4,872,216 A 10/1989 Wingo, Jr.
4,874,640 A 10/1989 Donzis
4,926,503 A 5/1990 Wingo, Jr
4,985,931 A 1/1991 Wingo, Jr.
5,029,341 A 7/1991 Wingo, Jr.
5,035,009 A 7/1991 Wingo, Jr. et al.
D328,159 S 7/1992 Donzis
5,159,715 A * 11/1992 Jurga et al. ..... 2/462

(Continued)

FOREIGN PATENT DOCUMENTS

CA 1322819 10/1989

(Continued)

*Primary Examiner*—Tejash Patel
(74) *Attorney, Agent, or Firm*—McDermott Will & Emery LLP

(57) ABSTRACT

The present invention provides a shoulder pad for use in a contact sport, such as football, hockey or lacrosse. The shoulder pad includes a pair of arch members, each having an upper portion, a front portion depending from the upper portion, and a rear portion depending from the upper portion. The shoulder pad further includes at least one side pad assembly having an epaulet and a shoulder cap, wherein the shoulder cap overlies the wearer's shoulder region and the epaulet overlies both the arch member and the shoulder cap. The side pad assembly is operably secured to the body arch member by a fastening assembly that includes a flexible single band. Unlike conventional designs, the single band secures both the epaulet and the shoulder cap to the upper portion of the arch member. The shoulder pad further includes a pair of interior pad assemblies wherein each interior pad assembly is removably connected to an arch member. The interior pad assembly is an integrated unit formed from a front pad, an intermediate pad, and a rear pad joined together to form distinct air management chambers.

26 Claims, 10 Drawing Sheets

U.S. PATENT DOCUMENTS

| | | | |
|---|---|---|---|
| 5,235,715 | A | 8/1993 | Donzis |
| 5,404,590 | A | 4/1995 | Monica, Jr. |
| 5,794,275 | A | 8/1998 | Donzis |
| 5,881,395 | A | 3/1999 | Donzis |
| 6,175,967 | B1 | 1/2001 | Donzis |
| 6,425,195 | B1 | 7/2002 | Donzis |

FOREIGN PATENT DOCUMENTS

| | | |
|---|---|---|
| CA | 2027405 | 2/1994 |
| CA | 2023673 | 11/1995 |

* cited by examiner

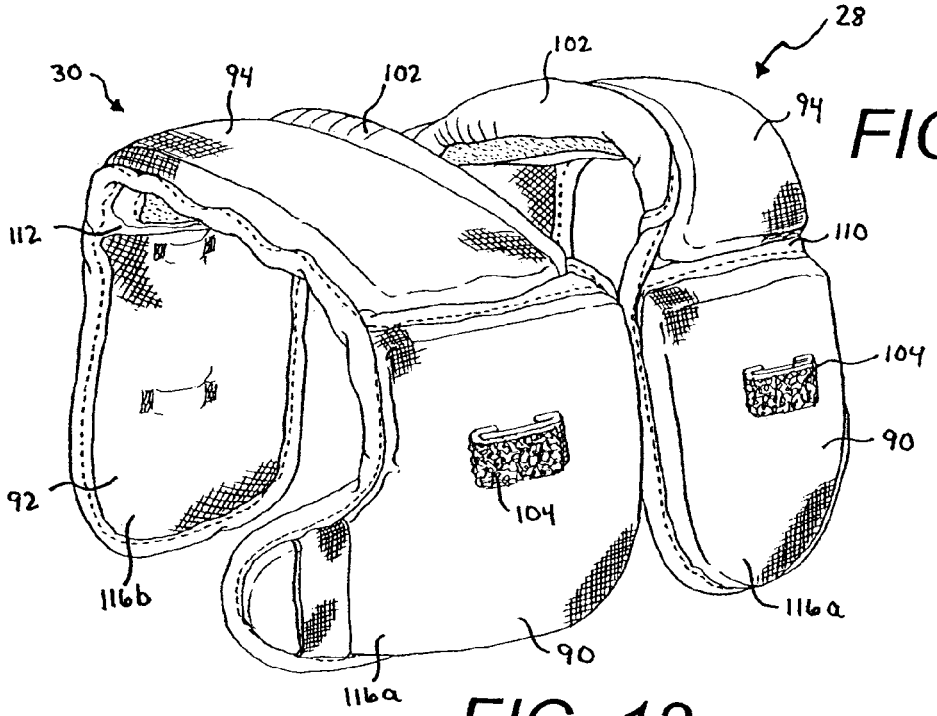
FIG. 11
FIG. 12
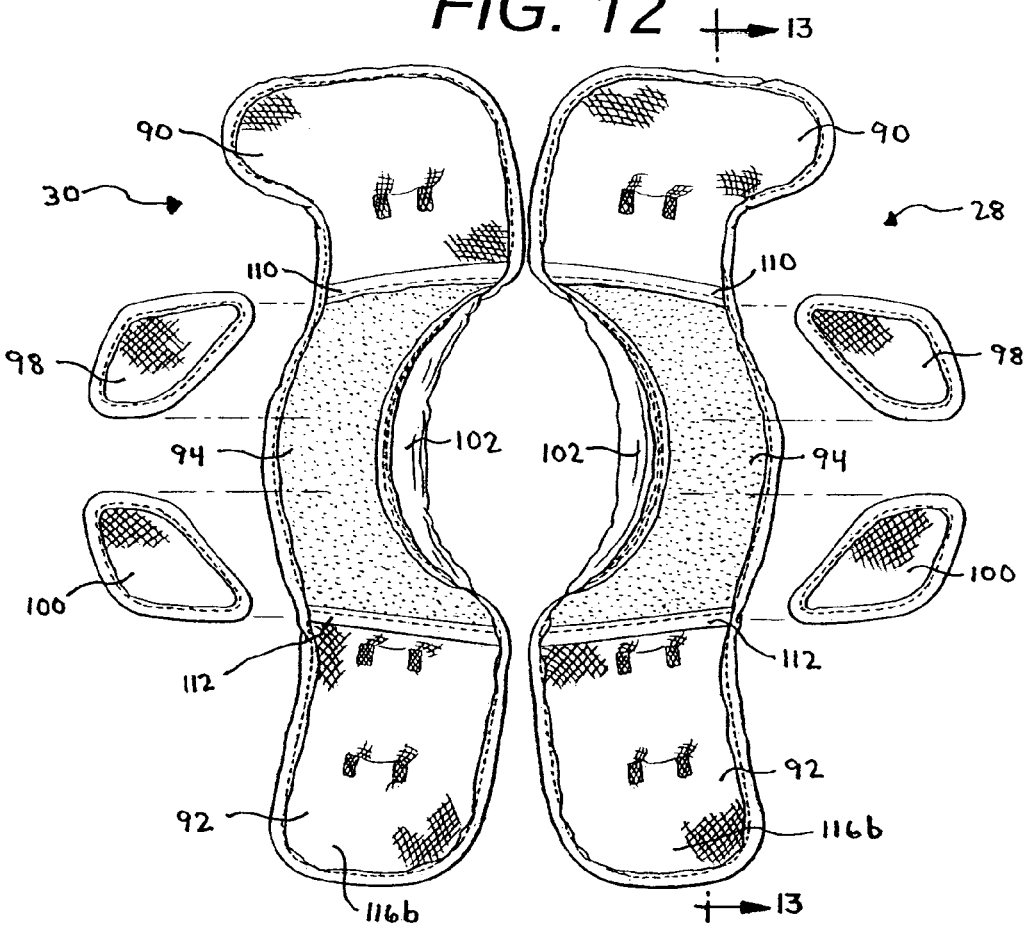

SHOULDER PAD FOR CONTACT SPORTS

CROSS-REFERENCE TO RELATED APPLICATIONS

This application claims priority from U.S. Provisional Patent Application No. 60/609,489, filed Sep. 13, 2004, which application is incorporated herein by reference and made a part hereof.

FEDERALLY SPONSORED RESEARCH OR DEVELOPMENT

Not applicable.

TECHNICAL FIELD

The invention relates to a shoulder pad assembly worn by a player in a contact sport, such as football, lacrosse or hockey. The shoulder pad has a novel fastening assembly for connection of a side pad assembly, an energy attenuation system for dissipating an impact force, and a unique integrated interior pad assembly.

BACKGROUND OF THE INVENTION

In most contact sports, the players are required to wear an assortment of protective gear, including shoulder pads, to reduce the occurrence of injury. For example, conventional football shoulder pads are bilaterally symmetrical and are generally comprised of right and left body arch members which extend over the shoulders and include anterior and posterior portions, or depending chest and back portions, which overlie the chest and back of the athlete. The posterior portions, or depending back portions may be permanently hinged together along a vertical axis over the athlete's back or spine, while the anterior portion, or depending chest portions, are connected together on a vertical line over the athlete's sternum as by means of straps or lacing.

A side pad assembly, comprising an epaulet and a shoulder cap, is rigidly linked by multiple connectors to the body arch member. The side pad assembly protects the player's shoulder wherein a portion of the body arch member overlies the acromioclavicular area (the "A.C." area), which includes the clavicle and the acromion, where the latter is the lateral extension of the spine of the scapula. In general, the A.C. area of the shoulder extends from the base of the neck downwardly towards the tip of the shoulder, or deltoid muscle. With conventional shoulder pad designs, the epaulet is pivotally connected to the arch member by a first strap and the shoulder cap is pivotally connected to the arch member by a second strap, wherein the epaulet overlies the shoulder cap. Due to the rigid connection provided by the straps, the range of motion of the side pad assembly is limited and the overall comfort of the shoulder pad is affected. The structural members, such as the body arch members, the shoulder caps and the epaulets, are manufactured from a material having the requisite strength characteristics to withstand the forces of impact incurred while playing contact sport. Conventional shoulder pads may also include a strap of material which has its ends fixedly secured to the body arch member, as by rivets or other suitable connectors. Typically, these straps are referred to as cantilever straps, and they support the body arch members in a spaced relationship from the pad body, as well as from the shoulder of the player.

Unlike football shoulder pads which include two distinct pads, the epaulet and the cap, which overlie the player's shoulder for protection thereof, conventional hockey and lacrosse pads feature only the shoulder cap. Hockey and lacrosse pads do not include the additional epaulet for a number of reasons, including the oversized configuration of the cap, the lower profile of the shoulder pads, and the reduced level of contact in these sports compared to football.

Existing shoulder pads also utilize a number of distinct interior pads disposed beneath the body arch members, wherein the interior pads are either fixedly secured, or releasably secured, to the body arch members. By using a number of distinct interior pads to form the interior pad elements, the construction of the shoulder pad and the fit of the shoulder pad can be affected.

Therefore, there is a definite need for a shoulder pad with a fastening assembly for the side pad assembly that does not inhibit the range of motion or comfort of the pad assembly. Further, there is a tangible need for an integrated interior pad assembly that can be quickly and easily joined to the arch members during the construction of the shoulder pad.

The present invention is provided to solve the problems discussed above and other problems, and to provide advantages and aspects not provided by prior shoulder pads.

SUMMARY OF THE INVENTION

The present invention relates to a shoulder pad that is to be worn by a participant of a contact sport, such as football, hockey or lacrosse. The shoulder pad includes a first body arch member, a second body arch member, a left side pad assembly flexibly connected to the left body arch member, and a right side pad assembly flexibly connected to the right body arch member. The shoulder pad further includes a left interior pad assembly removably affixed to the left body arch member and a right interior pad assembly removably affixed to the right body arch member.

According to one aspect of the invention, each side pad assembly includes an epaulet and an attached interior pad, and a shoulder cap and an attached interior pad. The arch members, the epaulets, and the shoulder caps are made of a material having the requisite strength and rigidity requirements to withstand the forces of impact incurred in the contact sport. Each side pad assembly is affixed to the upper portion of the body arch member by a fastening assembly that comprises a single flexible band and at least one rivet. Unlike conventional shoulder pad designs, the single band connects both the epaulet and the shoulder cap to the body arch member. The band has a first end that is affixed to the upper portion of the body arch member by a securing plate and at least one rivet that is driven therethrough. The band has an intermediate portion between the first end and a second end, wherein the intermediate portion is affixed to an inner surface of the epaulet by at least one rivet. The second end of the band is affixed to an inner surface of the shoulder cap by at least one rivet. Thus, a single flexible band is utilized to connect both the epaulet and the shoulder cap to the body arch member while providing a greater range of motion to the side pad assembly.

According to another aspect of the invention, the shoulder pad assembly includes an impact distribution and energy attenuation system that distributes and reduces an impact force throughout the pad assembly. As part of the system, the arch member has a raised segment that is aligned and cooperatively dimensioned with a raised segment of the shoulder cap. Furthermore, the epaulet has a raised segment that is aligned and cooperatively dimensioned with the other raised segments. The raised segments collectively define a channel that distributes and attenuates the force of impact received on the side pad assembly.

According to yet another aspect of the invention, the left and right interior pad assemblies comprise a number of distinct pads joined as an integrated padding unit. The interior pad assembly comprises a number of pads—a front pad, an intermediate pad, and a rear pad—joined to form distinct air management chambers. The pad element is formed from open-cell foam or closed-cell foam, or a combination thereof. The interior pad assembly may include a deltoid pad, wherein the deltoid pad extends from a portion of the front and intermediate pads. A front region of the interior pad assembly includes means for securing the pad assembly to the front portion of the body arch. Similarly, a rear region of the interior pad assembly includes means for securing the pad assembly to the rear portion of the body arch.

Compared to conventional shoulder pads, the present invention provides a number of advantages. The fastening assembly that secures the side pad assembly to the body arch member provides a greater amount of mobility for the side pad assembly with respect to the arch member. In addition, the fastening assembly comprises few parts, primarily the single band, and is easily installed on the shoulder pad thereby reducing both material and assembly costs. The raised segments of the arch member, the shoulder cap, and the epaulet form the distribution and energy attenuation system that distributes and generally reduces an impact force throughout the pad assembly. Regarding the integrated interior pad assembly, combining multiple pads into a single pad assembly provides for more efficient air management upon an impact to the shoulder pad. Furthermore, due to the integrated construction of the interior pad assembly, the shoulder pad is more comfortable for the participant to wear while playing the contact sport.

Other features and advantages of the invention will be apparent from the following specification taken in conjunction with the following drawings.

BRIEF DESCRIPTION OF THE DRAWINGS

FIG. 11 is a perspective view of an interior pad assembly of the shoulder pad of FIG. 1;

FIG. 12 is a top plan view of the interior pad assembly of FIG. 11; and, FIG. 13 is a cross section of the interior pad assembly taken along line 13-13 of FIG. 12.

DETAILED DESCRIPTION

Figure 1:
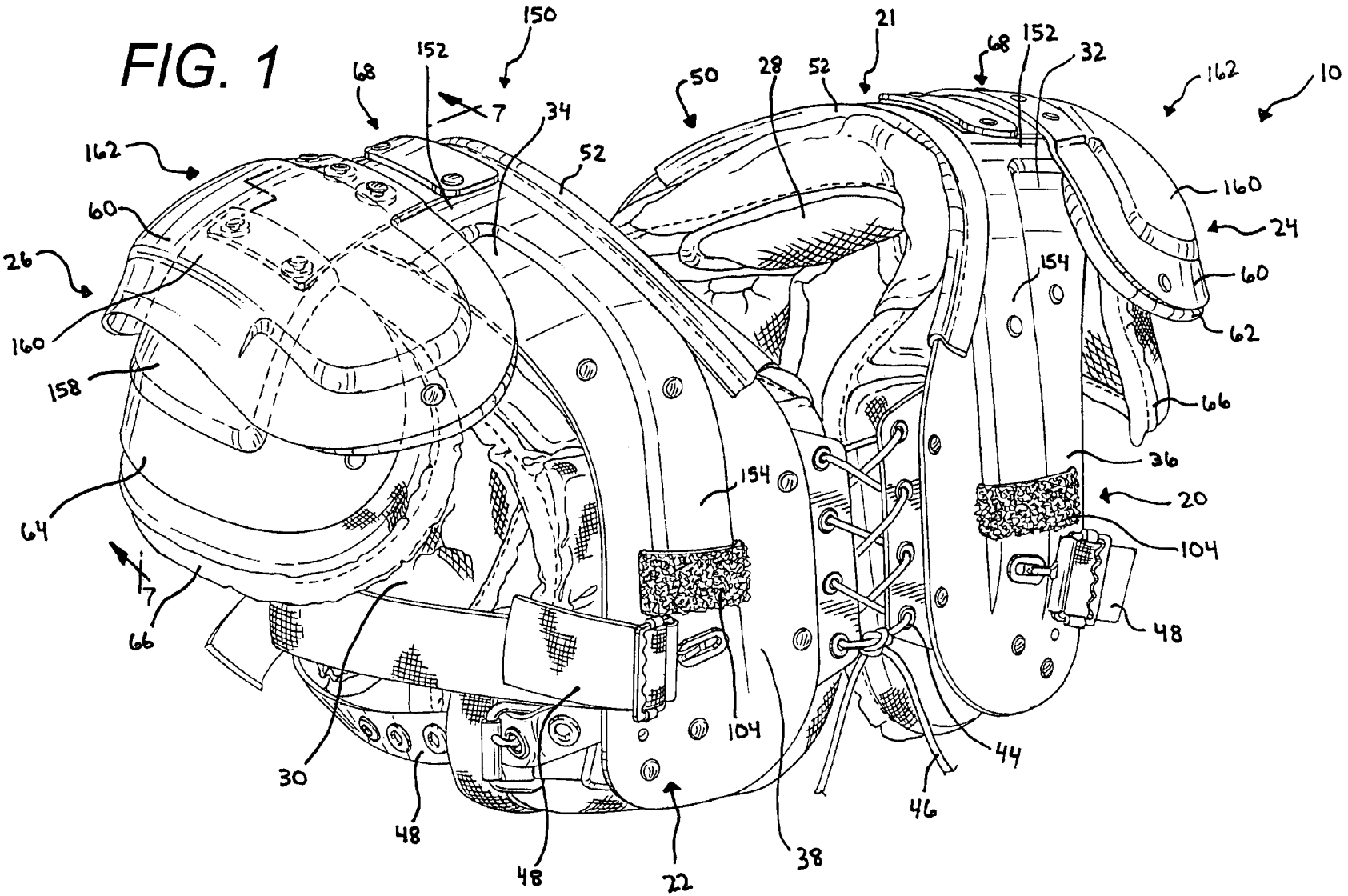
FIG. 1 is a front view of a shoulder pad of the invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A shoulder pad assembly 10 is shown in FIGS. 1 and 4-7. The shoulder pad 10 is configured to be worn by a participant of a contact sport, such as football, hockey or lacrosse. The shoulder pad 10 includes a first or left body arch member 20, a second or right body arch member 22, a left side pad assembly 24 flexibly connected to the left body arch member 20, and a right side pad assembly 26 flexibly connected to the right body arch member 22. A central body 21 is defined by the left and right body arch members 20, 22 which are operably joined to form the central body 21. Each of the side pad assemblies 24, 26 are configured to overlie a shoulder region of the wearer. The shoulder pad assembly 10 further includes a left interior pad assembly 28 removably affixed by fastening means 104 (see FIG. 11) to the left body arch member 20 and a right interior pad assembly 30 removably affixed by fastening means 104 to the right body arch member 22. Alternatively, the interior pad assemblies 28, 30 are permanently affixed to the respective body arch members 20, 22. The shoulder pad 10 may include a cantilever strap (not shown) positioned between each arch member 20, 22 and interior pad assembly 28, 30. In another configuration, the shoulder pad 10 includes a sub-arch padding element 15 (see FIG. 6) positioned between each arch member 20, 22 and interior pad assembly 28, 30. The cantilever strap and/or the sub-arch generally overlie the player's A.C. area and help to protect this area. The terms player, participant and wearer are used herein to denote a person that wears the shoulder pad assembly 10 for use in a contact sport.

Each body arch member 20, 22 includes an upper portion 32, 34, a front or chest portion 36, 38 depending from the upper portion 32, 34, and a rear or back portion 40, 42 depending from the upper portion 32, 34. Thus, the arch member 20, 22 is a single piece that extends between the wearer's lower chest region and lower back region. As shown in FIG. 1, the front portions 36, 38 feature a plurality of eyelets 44 configured to receive a string or lace 46 to adjust and position the body arch members 20, 22 over the wearer's sternum. Each body arch member 20, 22 includes at least one means for adjustably connecting the front portion 36, 38 and the rear portion 40, 42 thereof. The adjustable connection means can include a belt and buckle arrangement 48 or a hook and loop (Velcro®) strap. The rear portions 40, 42 of the arch members 20, 22 are spaced a distance apart and are connected by at least one strap affixed to the arch members 20, 22. The body arch members 20, 22 define a central opening 50 that permits the shoulder pad 10 to be placed over the participant's head and on the participant's shoulders. Each body arch member 20, 22 has a liner 52 along an extent of the edge proximate the central opening 50.

As shown in FIGS. 1 and 4-7, the side pad assembly 24, 26 includes an epaulet protective element 60 and an attached interior pad 62, and a shoulder cap protective element 64 and an attached interior pad 66. Preferably, the interior pads 62, 66 are attached to the epaulet 60 and the shoulder cap 64, respectively, by at least one rivet 51 (see FIG. 4). Alternatively, one or both of the interior pads 62, 66 are omitted from the side pad assembly 24, 26. The side pad assembly 24, 26 overlies and protects the deltoid muscle of the participant, wherein the epaulet 60 and interior pad 62 overlie the A.C. area and the upper deltoid muscle region, and the cap 64 and interior pad 66 overlie the outer region of the deltoid muscle. Described in a different manner, the shoulder cap 64 also overlies the acromion bone of the wearer, where the acromion is the lateral extension of the spine of the scapula, and the epaulet 60 overlies both the arch member 20, 22 and the cap 64. In one embodiment, the epaulet 60 has a curvilinear periphery with a perimeter that is less than a perimeter defined by the attached interior pad 62. Similarly, the shoulder cap 64 has a curvilinear periphery with a perimeter that is less than a perimeter defined by the attached interior pad 66. In this manner, the periphery of the interior pads 62, 66 extend beyond the periphery of the epaulet 60 and the cap 64, respectively. The arch members 20, 22, the epaulets 60, and the shoulder caps 64 can be made of a material having the requisite strength and rigidity requirements to withstand the forces of impact incurred in the contact sport. For example, the arch members 20, 22, the epaulets 60, and the shoulder caps 64 are formed from plastic, either the thermoplastic or thermoset variety. As another example, the arch members 20, 22, the epaulets 60, and the shoulder caps 64 are formed from high molecular weight polyethylene.

Referring to FIGS. 1 and 4-7, each side pad assembly 24, 26 is affixed to the upper portion 32, 34 of the body arch member 20, 22 by a fastening assembly 68 that comprises a single flexible band 70 and a plurality of rivets 72. The band 70 can be operably connected to either an upper surface or a lower surface of the body arch member 20, 22. The band 70 provides a common connection point on the arch member 20, 22 for both the epaulet 60 and the shoulder cap 64. The band 70 has a first end 74 that is affixed to the upper portion 32, 34 by a securing plate 76 and at least one rivet 72 that is driven therethrough. Alternatively, the securing plate 76 is omitted and the rivet 72 extends through the first end 74 of the band 70 and the arch member 20, 22. The rivet 72 can include a protective sheath 73 (see FIGS. 6 and 7). In yet another alternative, the first end 74 of the band 70 is secured under the liner 52 about the central opening 50 and both the plate 76 and the rivet 72 are omitted. Although the plate 76 is shown to have a generally rectangular configuration in FIG. 1, the precise configuration of the plate 76 can vary. For example, the plate 76 can have a square, elliptical, or circular configuration provided there is a sufficient surface area to interface with the first end 74 of the band 70, the upper portion 32, 34 and the rivet 72. The band 70 has a first or inner surface 78 that is in contact with an outer surface of the upper portion 32, 34, and a second or outer surface 80 (see FIG. 5) with portions that are in contact with the plate 76 and exposed (see FIG. 4).

Figure 4:
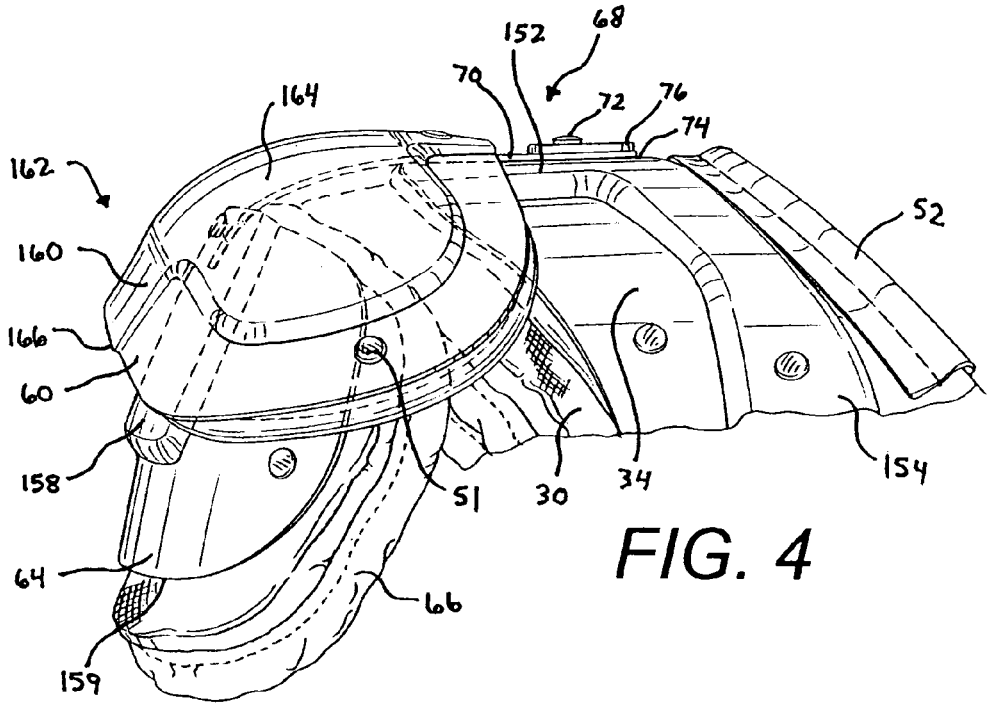
FIG. 4 is a perspective view of a side pad assembly of the shoulder pad assembly of FIG. 1.
Figure 5:
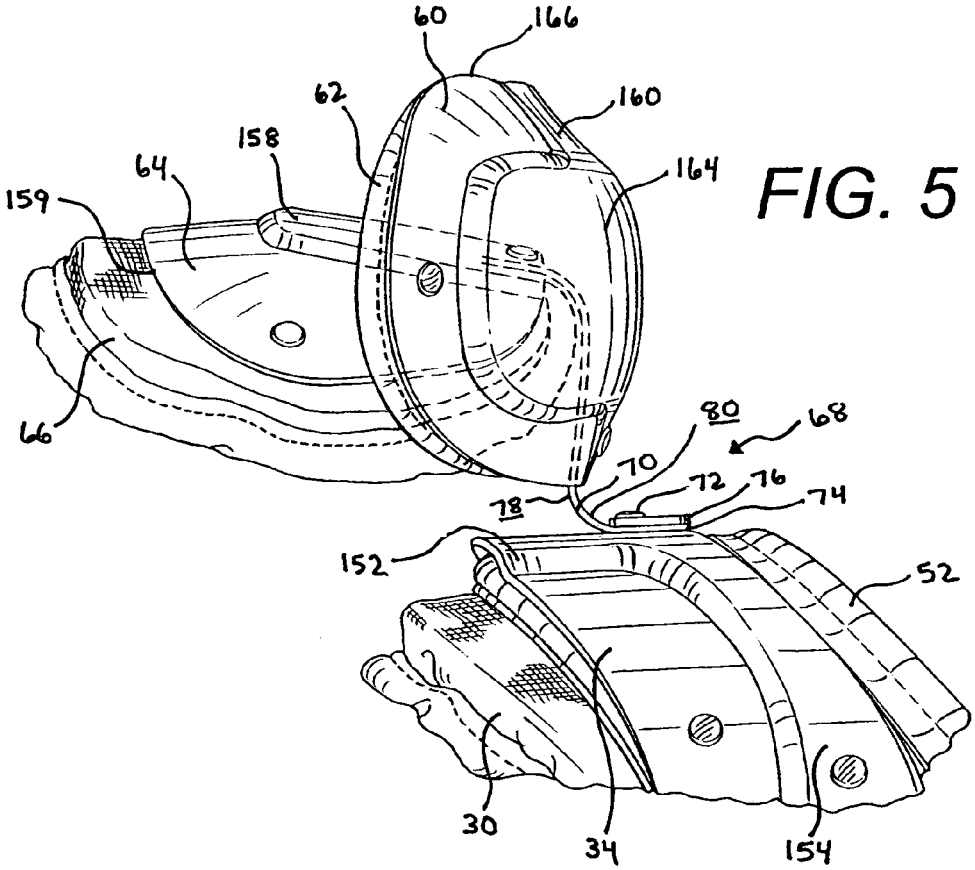
FIG. 5 is a perspective view of the side pad assembly of the shoulder pad assembly of FIG. 1, showing the side pad assembly in an elevated position.
Figure 6:
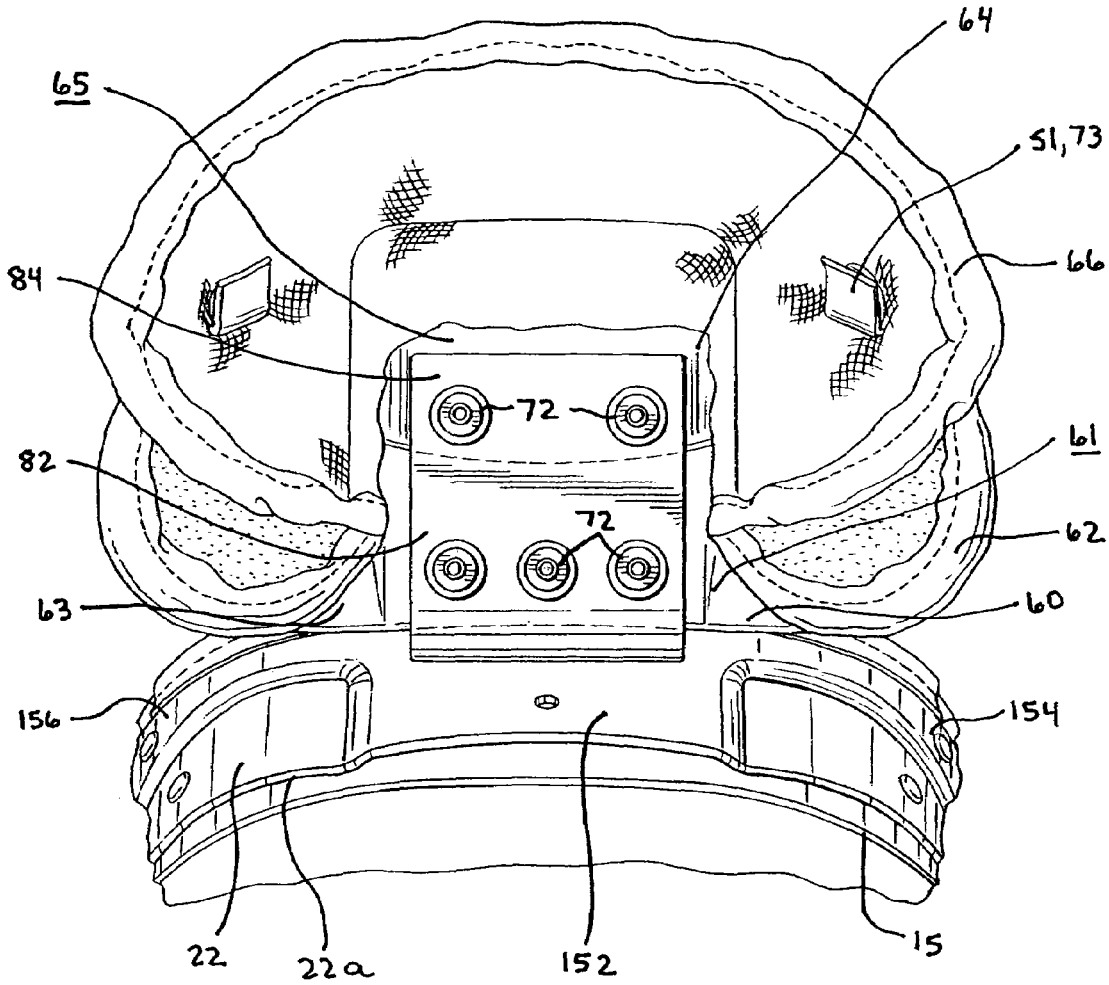
FIG. 6 is an end view of the side pad assembly of the shoulder pad of FIG. 1, showing the side pad in an elevated position.
Figure 7:
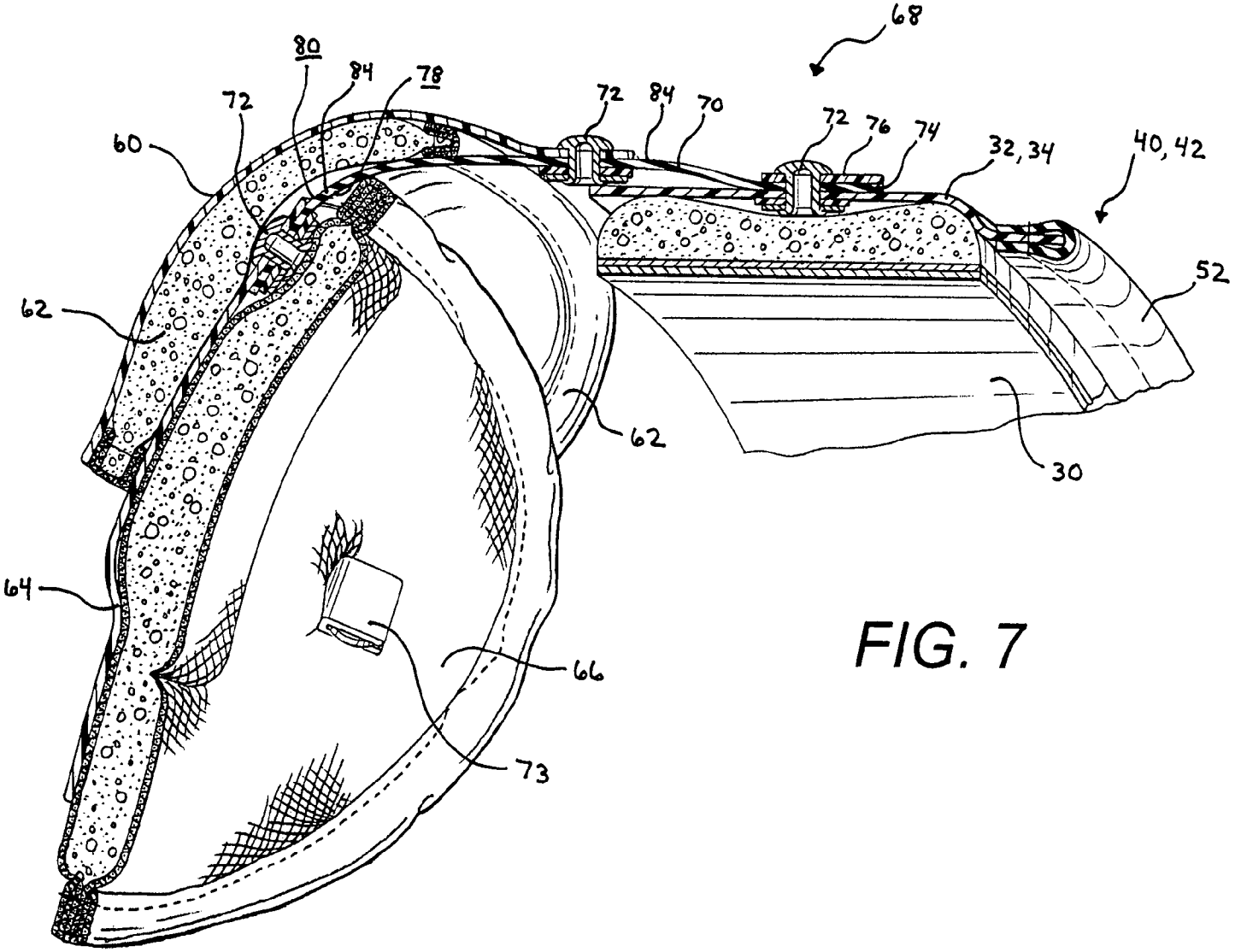
FIG. 7 is a cross section of the shoulder pad assembly taken along line 7-7 of FIG. 1.

The side pad assembly 24, 26 is shown in an elevated position in FIGS. 5 and 6, with a portion of the interior pad 66 removed in FIG. 6 for illustrative purposes. The band 70 has an intermediate portion 82 between the first end 74 and a second end 84. The intermediate portion 82 is affixed to an inner surface 61 of the epaulet 60 by at least one rivet 72. Near the intermediate portion 82, the second or outer surface 80 of the band 70 is in contact with the epaulet 60, while the first or inner surface 78 is in contact with an inner surface 67 of the interior pad 66. In the embodiment shown in FIG. 6, the interior pad 62 defines a recessed portion 63 near the connection area for the band 70 whereby the second surface 80 of the band 70 directly engages the inner surface 61 of the epaulet 60. In another embodiment, the interior pad 62 lacks a recessed portion 63, whereby the second surface 80 of the band 70 engages the interior pad 62 and the rivet 72 extends through the band 70, the interior pad 62, and the epaulet 60. When the side pad assembly 24, 26 is elevated or raised from the arch members 20, 22 in the manner shown in FIGS. 5 and 6, the second surface 80 of the band 70 envelops or wraps an extent of the periphery of the epaulet 60. The second end 84 of the band 70 is affixed to an inner surface 65 of the shoulder cap 64 by at least one rivet 72. Near the second end 84, the second or outer surface 80 of the band 70 is in contact with the shoulder cap 64, while the first or inner surface 78 is in contact with an inner surface 67 of the interior pad 66. Although not shown, a plate 76 may be employed to assist with the fastening of the second end 84 to the shoulder cap 64. In an initial or use position shown in FIGS. 1, 4, 6 and 7, the intermediate portion 82 and the second end 84 of the band 70 are positioned between an outer layer defined by the epaulet 60, the interior pad 62, and the shoulder cap 64, and a inner layer defined by the upper portion 32, 34 of the body arch member 20, 22 and the interior pad 66. In this manner, a significant extent of the band 70 is stacked between the inner layer and the outer layer.

As explained above, the band 70 of the fastening assembly 68 extends from the upper region 32, 34 of the arch member 20, 22 and away from the central opening 50 to flexibly secure the side pad assembly 24, 26 to the respective arch member 20, 22. As a result, the fastening assembly 68 provides a single linked attachment between the side pad assembly 24, 26 and the arch members 20, 22. Described in a different manner, the fastening assembly 68 provides for pivotal movement of the entire side pad assembly 24, 26 about the connection point when an upwardly directed force is applied thereto. Said upward force can result from the wearer raising an arm to throw or catch an object, such as a football. As an example, when the upwardly directed force is applied to the epaulet 60, both the epaulet 60 and the shoulder cap 64 pivot about the connection point on the arch member 22, 24.

Figure 2:
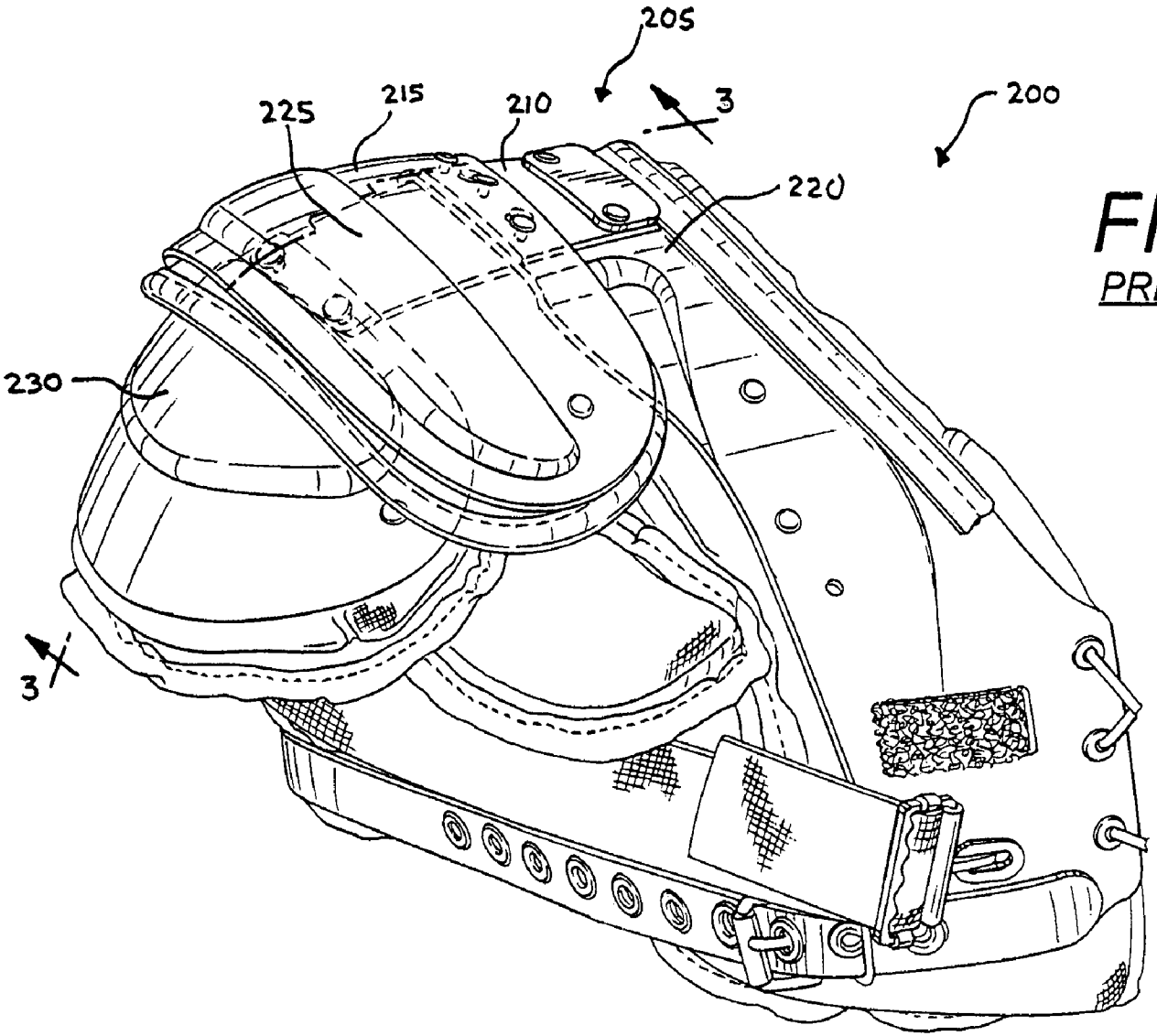
FIG. 2 PRIOR ART
FIG. 2 is a partial perspective view of a prior art shoulder pad.
Figure 3:
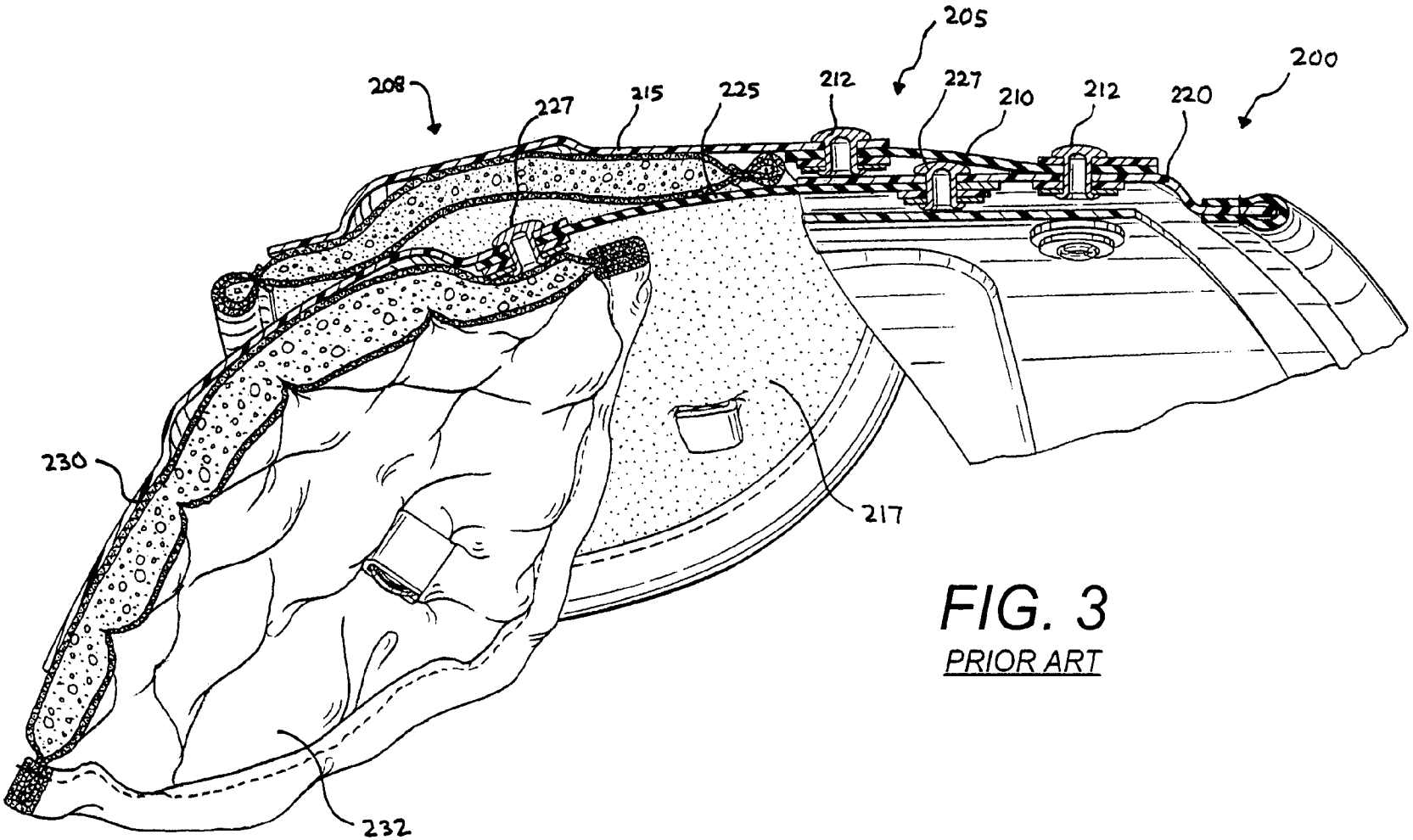
FIG. 3 PRIOR ART
FIG. 3 is a cross-section of the prior art shoulder pad taken along ling 3-3 of FIG. 2.

Unlike the shoulder pad 10 of the present invention, conventional football shoulder pads typically utilize multiple straps and connectors to fasten the side pad assembly to the arch members. FIGS. 2 and 3 show a conventional shoulder pad 200 with a multi-strap fastening assembly 205 for the side pad assembly 208, which consists of the epaulet 215 and the associated interior pad 217, and the shoulder cap 230 and the associated interior pad 232. The fastening assembly 205 includes a first strap 210 that connects the epaulet 215 to the arch member 220 with rivets 212. The fastening assembly 205 further includes a second strap 225 connects the shoulder cap 230 to the arch member 220 with rivets 227. Due to the multiple straps 210, 225, conventional football shoulder pads 200 have multiple connection points for each side pad assembly 208, which decreases the range of motion of the pad assembly 208.

Figure 8:
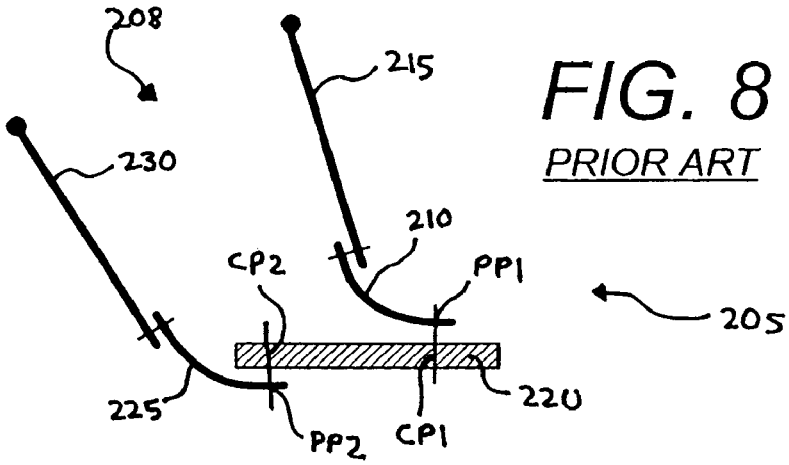
FIG. 8 PRIOR ART
FIG. 8 is a schematic view of the prior art shoulder pad, schematically showing the side pad assembly in an elevated position.
Figure 9:
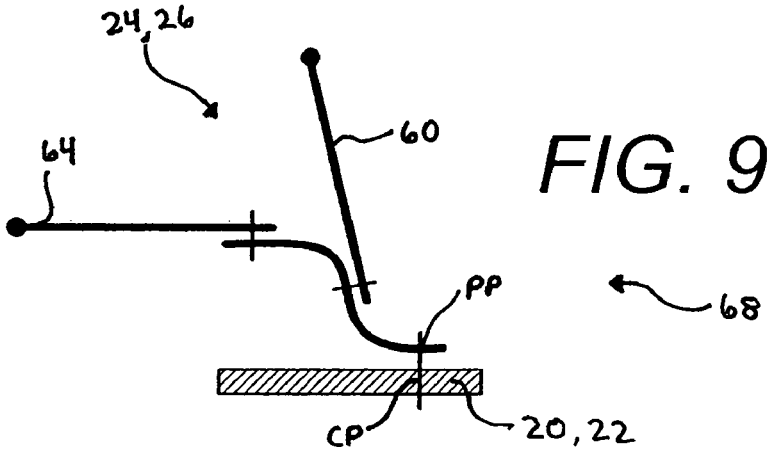
FIG. 9 is a schematic view of the shoulder pad of the invention, schematically showing the side pad assembly in a first elevated position.
Figure 10:
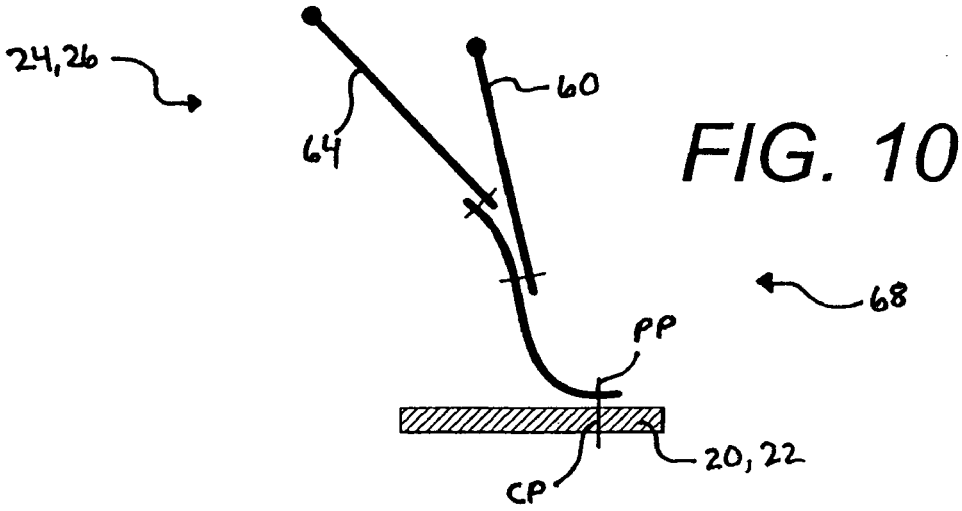
FIG. 10 is a schematic view of the shoulder pad of the invention, schematically showing the side pad assembly in a second elevated position.

In contrast to conventional designs and as schematically shown in FIGS. 8-10, the fastening assembly 68 provides a single pivot point PP for both the epaulet 60 and the shoulder cap 64 about the connection point CP on the arch member 20, 22. The single pivot point PP reflects the location where the side pad assembly 24, 26 pivots about the arch member 20, 22. The conventional shoulder pad 200 is schematically shown in FIG. 8, wherein the fastening assembly 205 has two distinct connectors—the first strap 210 and the second strap 225. The connection between the epaulet 215 and the first strap 210 provides a first pivot point PP1 and a first connection point CP1, while the connection between the shoulder cap 230 and the second strap 225 provides a second pivot point PP2. Due to the two pivot points PP1, PP2 and the two connection points CP1, CP2, the comfort and range of motion of the side pad assembly 208 is reduced.

Compared to conventional devices for securing side pad assemblies to arch members, the fastening assembly 68 of the present invention provides a number of benefits. Primarily, the fastening assembly 68, through the use of the single band 70, provides a greater amount of mobility for the side pad assembly 24, 26 with respect to the arch member 20, 22. As a result, the restrictions placed on the range of movement by conventional devices are not found in the present invention. In addition, when an impact is absorbed by the side pad assembly 24, 26, the fastening assembly 68 helps to maintain the proper positioning of the shoulder pad 10 on the player. Furthermore, the fastening assembly 68 comprises few parts, including the single band 70, and is easily installed on the shoulder pad 10 thereby reducing both material and assembly costs.

Figure 4A:
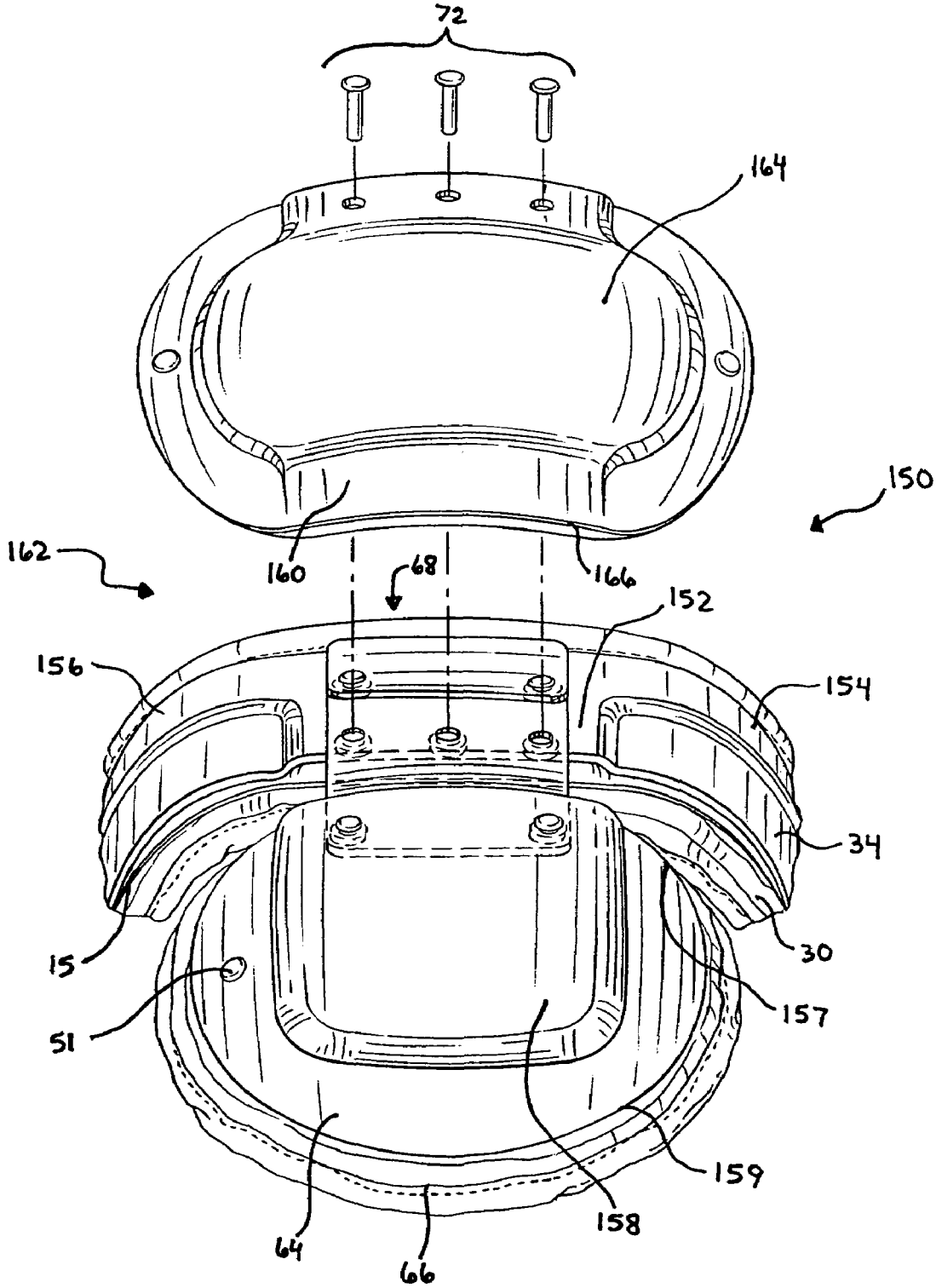
FIG. 4A is an exploded view of the side pad assembly of the shoulder pad assembly of FIG. 1.

The shoulder pad assembly 10 also includes an impact distribution and energy attenuation system 150 that is adapted to distribute an impact force throughout the pad assembly 10. Referring to FIGS. 1 and 4-6, the system 150 includes an upper raised arch segment 152, a front raised arch segment 154, and a rear raised arch segment 156. As shown in FIG. 6, the upper raised segment 152 extends outward from the front and rear raised arch segments 154, 156 to the outer edge 22*a* of the arch member 22. The system 150 further includes a raised segment 158 of the shoulder cap 64 and a raised segment 160 of the epaulet 60. Each of the raised segments 152, 154, 156, 158 represent a corrugation in the pad component, and the raised segments 152, 154, 156, 158 have a height defined by a sidewall that extends from the outer surface of the respective component of the pad assembly 10. In one embodiment, the segment height is approximately 0.25 inch. As shown in FIGS. 1, 4 and 4A, the upper raised arch segment 152 is cooperatively positioned and cooperatively dimensioned with the raised cap segment 158 to define a distribution and absorption channel 162 between the arch member 20, 22 and the cap 64. Therefore, the upper raised arch member 152 has a width that corresponds to a width of the raised cap segment 158. The fastening assembly 68 described above maintains the channel 162 through the close spacing of the cap 64 to the arch member 20, 22. In one embodiment, the inner periphery of the cap 64 is operably positioned approximately 1.0 inch from the outer periphery of the arch member 20, 22.

Referring to FIGS. 4, 4A and 5, the raised shoulder cap segment 158 has a length and extends outward from an inner edge 157 (see FIG. 4A) towards the outer edge 159 of the shoulder cap 64. The length of the raised cap segment 158 can vary with the design parameters of the energy attenuation system 150. For example, the raised cap segment 158 can extend between the inner and outer edges 157, 159 of the shoulder cap 64. Although shown as being uninterrupted or continuous, the raised cap segment 158 can be a series of projections that collectively define the segment 158. The raised epaulet segment 160 extends outward from a raised main portion 164 to the peripheral edge 166 of the epaulet 60. The raised epaulet segment 160 is cooperatively dimensioned and positioned with the raised cap segment 158 to further define the channel 162. The distribution and absorption channel 162 may also include the front and rear raised segments 154, 156 of the arch member 20, 22. Accordingly, the channel 162 may extend through the arch member 20, 22 and outward through the side pad assembly 24, 26. Referring to FIG. 6, there is a curvilinear transition region between the upper raised segment 152 and the front and rear raised segments 154, 156. The sub-arch member 15 may also include a raised segment that is cooperatively dimensioned and positioned with the upper raised segment 152.

When the shoulder pad assembly 10 is worn by a participant in a contact sport, e.g. football, hockey or lacrosse, the impact distribution and energy attenuation system 150 distributes and attenuates an impact force received on the side pad assembly 24, 26 in a controlled manner. An impact force is transferred through the side pad assembly 24, 26 and the arch member 20, 22. However, the system 150 prevents that force from being transferred to the wearer's acromioclavicular area (A.C. area) because the raised segments 152, 158 that overlie that area resist compression. Due to the corrugation that the raised segments 152-158 provide and under normal impact forces experienced during contact sports, the channel 162 does not compress and therefore does not engage the wearer's A.C. area. The channel's 162 lack of compression and engagement prevents the impact force from being transferred to the wearer's A.C. area. While the channel 162 resists compression and engagement with the A.C. area, the unraised portions of the arch member 20, 22 and the shoulder cap 62 compress an amount to engage the wearer's non-A.C. area and transfer the impact force thereto. It is understood that the side pad assembly 24, 26 and the arch members 20, 22 absorb a significant amount of energy thereby reducing the impact force transferred to the wearer.

Figure 13:
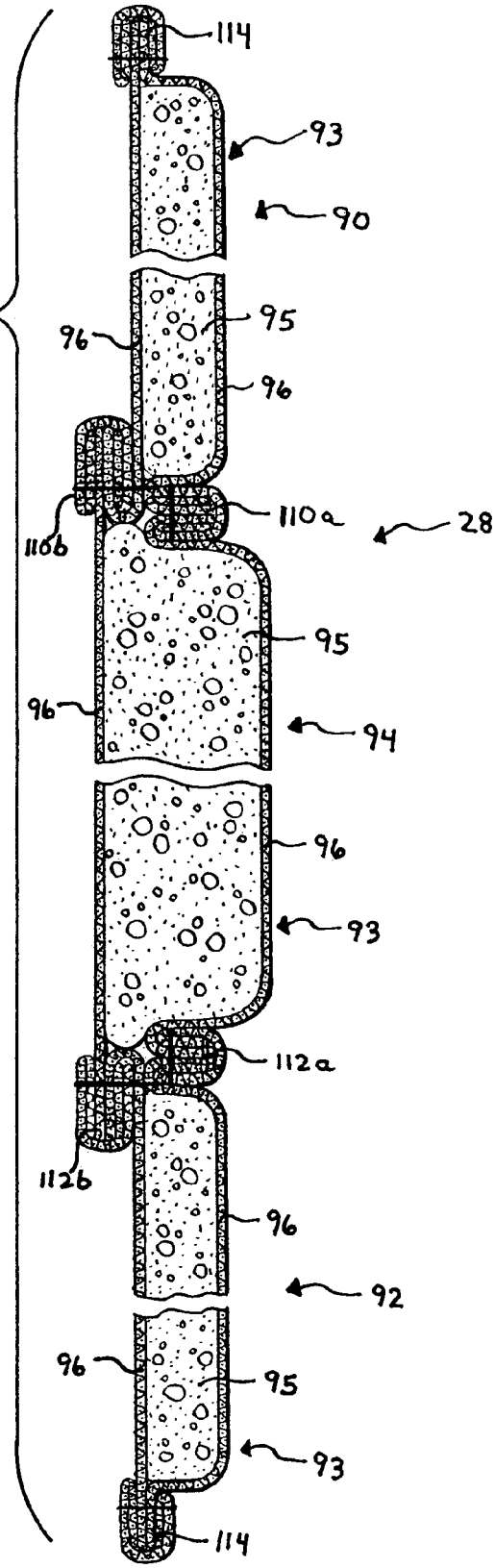

Referring now to FIGS. 11-13, the left and right interior pad assemblies 28, 30 comprise a number of distinct pads joined as integrated padding unit. The interior pad assembly 28, 30 comprises a front pad 90, a rear pad 92, and an intermediate pad 94 positioned between the front and rear pads 90, 92. Alternatively, the interior pad assembly 28, 30 comprises a front pad 90 and a rear pad 92, with the intermediate pad 94 omitted. The pad 90, 92, 94 comprises foam pad element 95 encapsulated in an air-tight membrane 96 (see FIG. 13). The membrane 96 is configured to prevent air from escaping from the pad element 95 when an impact force is applied to the shoulder pad assembly 10. In this manner, each pad 90, 92, 94 forms a distinct air management chamber 93 within the pad assembly 28, 30. Each air management chamber 93 restricts the release of air during an impact, while providing shock absorbing qualities through the compression of the air and the pad element 95 within the chamber 93. When an impact is received across a large area of the arch member 20, 22, such as the upper and front portions 32, 36 of the arch 20, multiple chambers 93 restrict air release and provide shock absorbing qualities. The pad element 95 can be a closed cell or open cell pad, or a combination thereof. The membrane 96 can be formed from flexible plastic, rubber, or air-tight fabric. Once affixed to a body arch member 20, 22, the interior pad 28, 30 extends from the front portion 36, 38 through the upper portion 32, 34 and to the rear portion 40, 42. In this manner, the interior pad 28, 30 is an integrated padding assembly that spans the length of the curvilinear body arch 20, 22. Conventional pad assemblies have a single pad element that spans the length of the body arch, wherein there is single air management chamber that spans the length of the body arch.

The interior pad assembly 28, 30 further includes a first removable pad 98 and a second removable pad 100, wherein each pad 98, 100 is removably received by the intermediate pad 94 with a hook and loop (Velcro®) fastener. When the pad assembly 28, 30 is installed in the shoulder pad 10, the first and second removable pads 98, 100 are positioned proximate the upper portion 32, 34 of the arch member 20, 22. The intermediate pad 94 has a inner comfort edge 102 that helps to prevent chafing with the player's torso region. The front pad

90 includes means for fastening 104 the pad 90 to the front portion 36, 38 of the body arch 20, 22. Similarly, the rear pad 92 includes means for fastening 104 the pad 92 to the rear portion 40, 42 of the body arch 20, The fastening means 104 is affixed to an inner surface 103 of the pad assembly 28, 30. The fastening means 104 can be a hook and loop (Velcro®) strap, a snap fastener, or a threaded fastener. As shown in FIG. 1, the fastening means 104 is threaded through openings in the body arch members 20, 22. When the pad assembly 28, 30 is fastened to the body arch member 24, 26, the arch member 24, 26 acts as a throttle for the air released from the pad element 95 upon an impact to the shoulder pad assembly 10.

As mentioned above, the front, rear and intermediate pads 90, 92, 94 are joined to form a single, integrated pad assembly 28, 30. The front pad 90 is joined to the intermediate pad 94 at a front divider or seam 110, and the rear pad 92 is joined to the intermediate pad 94 at a rear divider or seam 112. Referring to FIG. 13, the front seam 110 has a first and second component 110*a*, 110*b*, and the rear seam 112 has a first and second component 112*a*, 112*b*. Edging 114 is located at the periphery of the front, intermediate and rear pads 90, 92, 94. In the embodiment shown in FIGS. 11 and 12, the pads 90, 92, 94 are operably connected within a liner 116 having an exterior liner component 116*a* and an interior liner component 116*b*. Preferably, the exterior liner component 116*a* is a nylon membrane and the interior liner component 116*b* is an air permeable membrane. The liner 116 has a liner edging 118 that defines the periphery of the pad assembly 28, 30. In the cross-sectional view of FIG. 13, the external liner 116 is omitted wherein this omission does not affect the structure of the pads 90, 92, 94 or the chambers 93. There, the pad element 95 is positioned within the membrane 96 of each of the front pad 90, the rear pad 92 and the intermediate pad 94. To form the pads 90, 92, 94, the membrane 96 is heat sealed to enclose the pad element 95. Alternatively, the pad element 95 is enclosed within the membrane 96 via ultrasonic welding, radio frequency welding, or solvent or chemical bonding. To form the pad assembly 28, 30, each pad 90, 92, 94 can be formed separately and then joined together at the seams 110, 112 within the liner 116, or all pads 90, 92, 94 are simultaneously formed within a die having a partition for the seams 110, 112 and within the liner 116.

The resulting pad assembly 28, 30 has a length that corresponds to the length of the body arch 20, 22 thereby providing an integrated padding element for the body arch 20, 22 with multiple air management chambers. Combining and integrating multiple pads 90, 92, 94 as a single pad assembly 28, 30 permits the pad assembly 28, 30 to be easily installed to the arch member 20, 22 compared to the piecemeal installation required by conventional multiple inner pads. As a result, the material and assembly costs of the shoulder pad 10 are lowered. Furthermore, due to the integrated construction of the pad assembly 28, 30, the shoulder pad 10 is more comfortable for the participant to wear while playing the contact sport.

It is to be understood that the invention is not limited to the exact details of construction, operation, exact materials or embodiments shown and described, as obvious modifications and equivalents will be apparent to one skilled in the art; for example, the entire cantilever strap could be provided with a shock absorbing pad disposed upon its lower surface. Accordingly, the invention is therefore to be limited only by the scope of the appended claims. While the specific embodiments have been illustrated and described, numerous modifications come to mind without significantly departing from the spirit of the invention, and the scope of protection is only limited by the scope of the accompanying Claims.

What is claimed is:

1. A shoulder pad that is worn by a player in a contact sport, the shoulder pad comprising:

a central body having a pair of protective arch members operably connected, each arch member having a protective lower chest portion and a protective lower back portion and an upper portion with a raised upper segment;

a side pad assembly operably connected to each arch member, the side pad assembly having an epaulet and a shoulder cap, wherein the shoulder cap overlies an acromion bone of the player and wherein the epaulet overlies a portion of both the arch member and the shoulder cap, and wherein the shoulder cap has a raised cap segment that is cooperatively dimensioned with the raised upper segment;

a fastening assembly with a single, continuous flexible band that secures both the epaulet and the shoulder cap to the arch member; and, wherein the raised upper segment is aligned with the raised cap segment when the shoulder pad is worn by the player.

2. The shoulder pad of claim 1, wherein an inner surface of the flexible band engages an outer surface of the central body, and an outer surface of the band engages an inner surface of the epaulet and an inner surface of the shoulder cap.

3. The shoulder pad of claim 1, wherein a first end of the band is secured to an outer surface of an upper portion of the central body.

4. The shoulder pad of claim 3, wherein a second end of the band is secured to the shoulder cap, and wherein an intermediate portion of the band is secured to the epaulet.

5. The shoulder pad of claim 1, wherein the fastening assembly further includes a plurality of rivets that extend through the band and the central body.

6. The shoulder pad of claim 1, wherein the epaulet and the shoulder cap are formed from impact resistant plastic.

7. The shoulder pad of claim 1, further comprising an interior pad assembly removably connected to an arch member, wherein the interior pad assembly is an integrated unit formed from an open-cell front pad and an open-cell rear pad joined together.

8. The shoulder pad of claim 1, wherein the epaulet has a raised epaulet segment that is cooperatively dimensioned with and aligned with the raised cap segment when the shoulder pad is worn by the player to further provide the impact attenuation system.

9. A shoulder pad assembly for use by a participant in a contact sport, the shoulder pad assembly comprising:

a pair of curvilinear arch members joined together, each arch member having an upper portion with a raised upper segment;

a side pad assembly having an epaulet and a shoulder cap, wherein the shoulder cap overlies an outer portion of the clavicle of the participant, and wherein die epaulet overlies a portion of both the arch member and the shoulder cap; and, a single, continuous and flexible band that is the sole means to operably connect both the epaulet and the shoulder cap to a common connection point on an outer surface of the raised upper segment of one of the arch members.

10. The shoulder pad assembly of claim 9, wherein due to the operable connection provided by the band, an upwardly directed force applied to the epaulet causes both the epaulet and the shoulder cap to pivot about the connection point.

11. The shoulder pad assembly of claim 9, wherein the raised upper segment that leads to both a raised front segment extending along a front portion of the arch member and a raised rear segment extending along a rear portion of the same arch member.

12. The shoulder pad of claim 9, wherein the arch members, the epaulet, and the shoulder cap are formed from impact resistant plastic.

13. The shoulder pad of claim 9, further comprising an interior pad assembly removably connected to each of the arch members, wherein each interior pad assembly is an integrated unit formed from joining an open-cell front pad element, an open-cell intermediate pad element, and a open-cell rear pad element.

14. The shoulder pad of claim 9, wherein the shoulder cap has a raised cap segment, and wherein the raised upper segment is both cooperatively dimensioned with and aligned with the raised cap segment when the shoulder pad is worn by the participant to provide an impact attenuation system.

15. A shoulder pad that is worn by a player in a contact sport, the shoulder pad comprising:

a central body having a pair of protective arch members operably connected together to define a central opening, each arch member having an upper portion with a raised upper segment that leads to both a raised front segment extending downwardly along a front portion of the arch member and a raised rear segment extending downwardly along a rear portion of the arch member; and, a side pad assembly operably connected to the upper portion of each arch member by a single flexible band, the side pad assembly having an epaulet and a shoulder cap, wherein the shoulder cap has a raised segment that is aligned wit the raised arch segment when the shoulder pad is worn by the player, the alignment of the raised upper and cap segments providing energy attenuation for an impact to the side pad assembly.

16. The shoulder pad of claim 15, wherein the epaulet overlies a portion of both the arch member and the shoulder cap, the epaulet having a raised epaulet segment that is aligned with both the raised upper segment and the raised cap segment when the shoulder pad is worn by the player.

17. The shoulder pad of claim 15, wherein the flexible band has a first end that is secured to an outer surface of an upper portion of the arch member.

18. The shoulder pad of claim 15, wherein the operable connection of the shoulder cap to the arch member by the flexible band results in the shoulder cap being spaced approximately one inch from the arch member.

19. The shoulder pad of claim 15, wherein the raised upper segment is positioned adjacent an outer periphery of the arch member.

20. The shoulder pad of claim 19, wherein the raised cap segment is positioned adjacent an inner periphery of the shoulder cap.

21. The shoulder pad of claim 15, wherein the epaulet has a recess cooperatively dimensioned with the raised cap segment to facilitate nesting between the epaulet and the shoulder cap.

22. The shoulder pad of claim 21, wherein the epaulet has a pad element with a recess cooperatively dimensioned with the raised cap segment.

23. The shoulder pad of claim 15, wherein the arch member, the epaulet and the shoulder cap are formed from high molecular weight polyethylene.

24. The shoulder pad of claim 15, wherein the raised arch segment and the raised cap segment have a height of at least 0.25 inch.

25. The shoulder pad of claim 15, wherein the shoulder cap has a major axis, the raised cap segment oriented perpendicular to the major axis.

26. A shoulder pad that is worn by a player in a contact sport, the shoulder pad comprising:

a pair of curvilinear arch members joined together to define a central opening, each arch member having a raised front segment extending along a front arch portion and a raised rear segment extending along a rear arch portion, wherein the front and rear segments converge at an raised upper segment of an upper portion of the arch member, wherein the raised upper segment extends from the convergence of the front and rear segments to an outer edge of the arch member; and, a side pad assembly operably connected to each arch member by a flexible band, the side pad assembly having an epaulet and a shoulder cap, wherein the shoulder cap has a raised segment that is aligned with the raised upper segment when the shoulder pad is worn by the player to provide energy attenuation for an impact to the side pad assembly.

* * * * *

UNITED STATES PATENT AND TRADEMARK OFFICE

CERTIFICATE OF CORRECTION

PATENT NO. : 7,506,384 B2
APPLICATION NO. : 11/224493
DATED : March 24, 2009
INVENTOR(S) : Thad M. Ide and Christopher D. Oby It is certified that error appears in the above-identified patent and that said Letters Patent is hereby corrected as shown below:

In Column 10, line 67, please delete the word "that".

In Column 11, line 11, please replace "a" with --an--.

Signed and Sealed this

Fourteenth Day of December, 2010

David J. Kappos

David J. Kappos
*Director of the United States Patent and Trademark Office*